US005189772A

United States Patent [19]

Appelt

[11] Patent Number: 5,189,772

[45] Date of Patent: Mar. 2, 1993

[54] METHOD OF UPHOLSTERING

[75] Inventor: John W. Appelt, Sooke, Canada

[73] Assignee: Key Plastics Sales, Inc., Upper Sandusky, Ohio

[21] Appl. No.: 640,874

[22] Filed: Jan. 14, 1991

[51] Int. Cl.[5] ..... B68G 7/00

[52] U.S. Cl. ..... 29/91.1; 29/91.5; 29/91.6

[58] Field of Search ..... 29/91.4, 91.5, 91.6, 29/91.7, 91.8, 33 E, 33.52, 235, 243.57, 91.1; 49/498, 499; 5/192, 474

[56] References Cited

U.S. PATENT DOCUMENTS

| | | | |
|---|---|---|---|
| 811,366 | 1/1906 | Boller | 29/91.6 |
| 1,645,120 | 9/1925 | Sterbenz . | |
| 1,864,477 | 6/1932 | Stannard | 29/91.5 X |
| 2,051,191 | 8/1936 | Watson . | |
| 2,827,280 | 3/1958 | Burkhalter | 49/498 X |
| 3,649,974 | 3/1972 | Baruth et al. | 5/474 X |
| 3,754,308 | 8/1973 | Staley | 29/91.1 |
| 3,979,807 | 9/1976 | Hubbs et al. | 29/91.4 |
| 4,370,792 | 2/1983 | Watts | 29/235 X |
| 4,431,229 | 2/1984 | Unger | 29/91.5 X |
| 4,458,387 | 7/1984 | Pearson . | |
| 4,650,251 | 3/1987 | Shimada | 5/474 X |
| 4,682,925 | 7/1987 | Shields . | |
| 4,732,097 | 3/1988 | Guilhem | 29/91.5 X |
| 4,765,045 | 8/1988 | Selbert et al. | 29/235 X |
| 4,831,697 | 5/1989 | Urai | 29/91.5 X |
| 4,987,666 | 1/1991 | Smith | 29/91.1 |

FOREIGN PATENT DOCUMENTS

| | | | |
|---|---|---|---|
| 0715399 | 12/1941 | Fed. Rep. of Germany | 5/474 |
| 0270374 | 4/1930 | Italy | 5/474 |

*Primary Examiner*—Timothy V. Eley
*Assistant Examiner*—C. Martin
*Attorney, Agent, or Firm*—Beveridge, DeGrandi, Weilacher & Young

[57] ABSTRACT

An upholstering device wherein a single piece upholstering device may be used to cover a surface, having both straight and curved perimeters, with fabric. The upholstering device has elevating sections and joining sections. The upholstering device forms its own piping when fabric is secured to perimeter of surface to be covered.

Also, method of covering a surface with a single piece upholstering device. The fabric is secured to the surface with fasteners passing through the fabric and the joining section of the upholstering device. By securing the fabric to the surface, the elevating sections are drawn together, forming piping.

7 Claims, 1 Drawing Sheet

METHOD OF UPHOLSTERING

BACKGROUND

1. The Field of the Invention

The present invention relates to an upholstering device for covering a surface with fabric. More particularly, the present invention allows a surface to be upholstered with a one-piece device and fasteners.

2. The Prior Art

In the past, upholstering has been a complicated process that required several devices and procedures. A conventional method of upholstering begins by attaching piping, which is sewn and stapled along the edge of the surface to be covered.

When the perimeters of the surface to be covered are straight, a cardboard strip containing tacks must be used. The ends of the fabric are wrapped around the cardboard strip and stapled. The tacks in the strip are then nailed along the straight perimeters of the surface, thereby securing the fabric to the surface.

When the perimeters of the surface to be covered are curved, the upholsterer generally uses an aluminum tacking device. The tacking device is stapled along the perimeter of the surface. The ends of the fabric are then wrapped around the tacking device. Finally, the upstanding portion of the device is bent downward to secure the ends of the fabric to the perimeter.

Although other inventions have been developed to simplify and improve the upholstering process, none have allowed the upholstering of both straight and curved perimeters with only one-piece device and fasteners.

BRIEF SUMMARY AND OBJECTS OF THE INVENTION

One object of the present invention is to provide an upholstering device whereby the process of covering a surface with fabric is made simpler and more efficient.

Another object of the invention is to allow a surface to be covered with fabric using an essentially one-piece device and fasteners, as opposed to the conventional method of using piping, cardboard strips, tacking devices and fasteners. By forming its own piping, the present invention eliminates the need for conventional upholstering apparatus.

A third object of the present invention is to provide an upholstering device which may be used to attach the edges of a fabric to both straight and curved perimeters.

The objects of the present invention are accomplished by an upholstering device which has substantially three parts: two parallel elevating means for elevating the fabric from the perimeter of the surface to be covered, and a joining means or rib for joining the two elevating means to form an elongated strip.

In using the present invention, the upholstering device is placed along the straight perimeters of the surface to be covered so that the parallel elevating portions are also parallel with the perimeter. The surface and device are covered with the fabric, and the edges of the fabric are then tucked under the device. This is done in such a way as to bring the edges of the fabric underneath the joining portion or rib of the device while leaving some slack in the fabric over the surface.

To secure the fabric to the surface to be covered, the fabric over the joining means is stapled to the perimeter of the surface underneath. In this way, the staple passes through the fabric over the joining means, through the joining means itself, and through the fabric underneath the joining means into the perimeter of the surface. This has the result of drawing the fabric down between the elevating means, thereby reducing the slack of the fabric over the surface and producing the desired fabric tension. This also draws the two elevating means towards each other, so that, in effect, the device creates its own piping.

The device is used in the same manner as above to attach the fabric to curved perimeters. Sections of the innermost elevating means are removed at curves. This allows the device as a whole to be bent in these areas, so that the device remains parallel to the curved perimeters of the surface. Bending the device closes the gap left by the removed section of the innermost elevating means. Therefore, even with curved perimeters, the device is used with the same method as with the straight edges. This allows the device to be implemented in a single continuous strip. More specifically, the device can be used as a single strip which may be sized to any convenient length. Generally, the length should be what is necessary to lay the strip out around the perimeter of the surface to be covered.

DETAILED DESCRIPTION OF THE PREFERRED EMBODIMENTS

Figure 1:
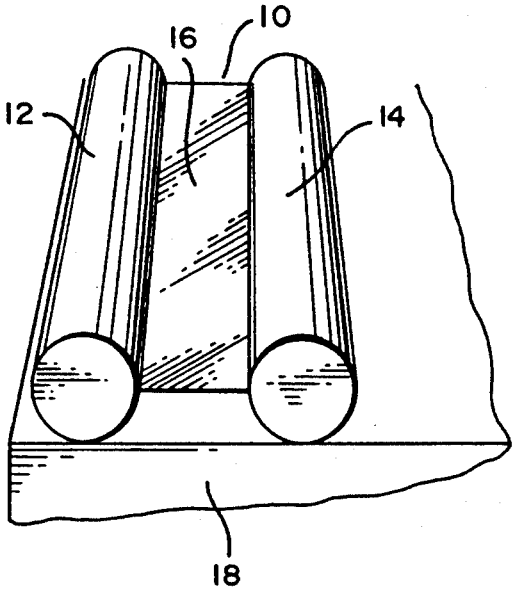
FIG. 1 is an elevated view of one embodiment of the present invention.

Reference is now made to the drawings wherein like parts are designated with like numerals throughout. Referring initially to FIG. 1, one preferred embodiment of the present invention of an upholstering device (10) is shown. A first elevating means (12) is joined to a second elevating means (14) by a joining means (16). Both elevating means (12 and 14) are similar in size and shape. Furthermore, both are cylindrical and elongated along the axis of the center of their circular surface.

The joining means (16) is a thin sheet, ideally joining the elevating means (12 and 14) so that their axes of elongation are in the same plane as the joining means (16). For this embodiment, the width of the joining means (16) is approximately equal to the height of the elevating means (12 or 14).

It is anticipated that the entire device be a single piece made of resilient or flexible plastics or rubbery materials, which are well known in the art. The joining means (16) should be rigid enough to hold its shape when bent.

To use the present invention to cover a surface with fabric, the device is sized as necessary to match the perimeter (18) of the surface. The upholstering device (10) is then positioned down around the perimeter (18) of the surface generally in one continuous strip. This is done so that the elevating means (12 and 14) are substantially parallel to the perimeter (18), as shown in FIG. 1. This creates the effect of an inside elevating means (seen as 14) and an outside elevating means (seen as 12).

The fabric is then placed over the surface, covering the surface, generally in one continuous strip. This is done so that the edges of the fabric also cover and overhang the upholstering device (10). More particularly, the fabric should overhang the upholstering device (10) by at least as much as the width of the device.

Figure 2:
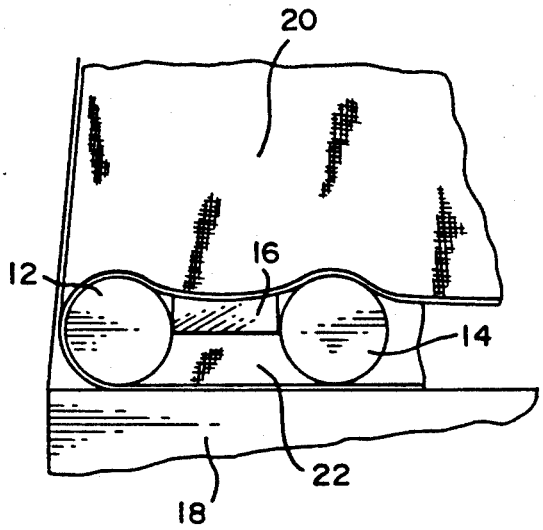
FIG. 2 is the same view as FIG. 1 including the fabric as it is placed around an embodiment of the present invention.

To secure the fabric to the surface and complete the upholstery, the overhanging fabric is tucked between the upholstering device (10) and the surface perimeter (18). As shown in FIG. 2, this should be done so that a portion of the fabric (20), having some slack, is over the joining means (16) and a portion of the fabric (22) lies between the joining means (16) and the surface perimeter (18). Finally, the portion of the fabric (20) over the joining means (16) is fastened to the surface perimeter (18) by a staple (24).

Figure 3:
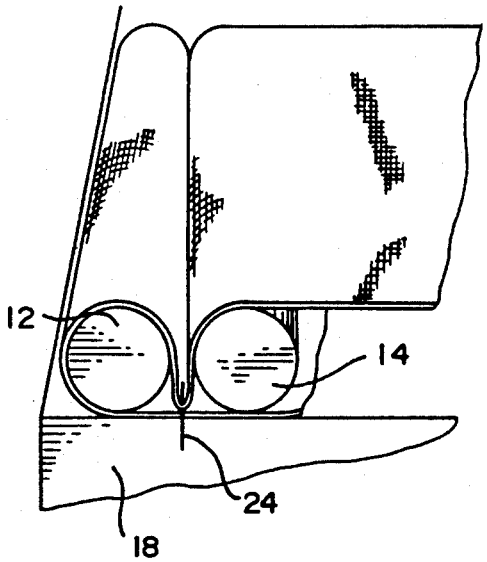
FIG. 3 is an elevated view of the finished use of an embodiment of the present invention.

By stapling the portion of fabric (20) to surface perimeter (18), the portion of fabric (20) is drawn downward between the elevating means (12 and 14), as shown in FIG. 3. This reduces the slack in the portion of fabric (20) to a desired tension. Also, since the staple (24) passes through the joining means (16), the joining means (16) is drawn downward towards the surface perimeter (18). This in turn draws the elevating means (12 and 14) together, so that they form piping for the upholstery.

Figure 4:
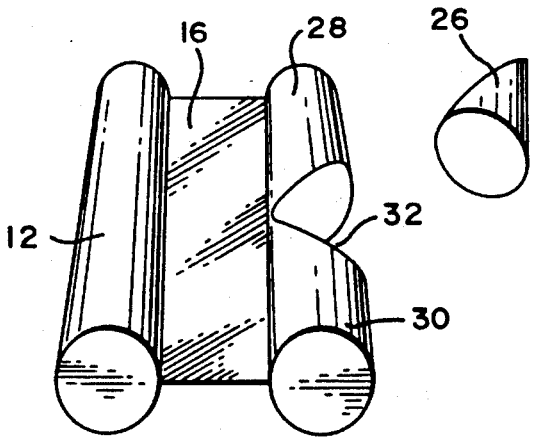
FIG. 4 is an elevated view of an embodiment of the present invention to be used with curved perimeters.

While the aforementioned process is used primarily for straight perimeters, it may be modified for curved perimeters. In the modified method, the upholstering device (10) is bent to follow the curves of the perimeter. As shown in FIG. 4, sections of the inside elevating means (26) are removed from locations where the upholstering device (10) is bent.

The bending of the upholstering device (10) forces the remaining portions (28 and 30) of the inside elevating means towards each other, closing the gap (32) left by the removed sections (26). Thus, the upholstering device (10) remains parallel to the perimeter (18) even through curves. This allows the bent lengths of the upholstering device (10) to be used in the same manner disclosed above. This allows the upholstering device (10) to be layed out around the perimeter of the surface in a single continuous strip. Further, this eliminates the need for seperate upholstering devices for curved perimeters and straight perimeters.

Although the device of the invention is illustrated with the elevating means of circular cross section, any convenient shape can be used.

Further variations and modifications of the foregoing will be apparent to those skilled in the art and are intended to be encompassed by the claims appended hereto.

What is claimed is:

1. A method of covering a surface with fabric comprising:

laying an upholstering piping means along a surface to be covered, said upholstering piping means being a single piece of resilient material including first and second elongated elevating means joined by a joining means, laying fabric over said surface such that said fabric also covers said upholstering piping means, and attaching said fabric to said surface with a fastener, such that said fastener passes through said joining means, thereby drawing said joining means toward said surface and drawing said first and second elevating means together to form piping.

2. A method of covering a surface with fabric in accordance with claim 1, wherein said upholstering piping means is laid on a surface to be covered such that said upholstering piping means is substantially parallel to a perimeter of a surface to be covered.

3. A method of covering a surface with fabric in accordance with claim 1, including the step of tucking a portion of said fabric between said upholstering piping means and said surface.

4. A method of covering a surface with fabric in accordance with claim 3, wherein said portion is tucked underneath said joining means.

5. A method of covering a surface with fabric in accordance with claim 1, including the step of removing a section of said upholstering piping means and laying said upholstering piping means on said surface with a bend at said removed section.

6. A method of covering a surface with fabric in accordance with claim 1, wherein said first and second elevating means are substantially parallel.

7. A method of covering a surface with fabric in accordance with claim 1, wherein said elevating means are cylindrical.

* * * * *